US007429235B2

(12) United States Patent
Lin

(10) Patent No.: US 7,429,235 B2
(45) Date of Patent: Sep. 30, 2008

(54) DUMBBELL

(75) Inventor: William Lin, Taichung (TW)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 11/520,259

(22) Filed: Sep. 13, 2006

(65) Prior Publication Data

US 2008/0070761 A1 Mar. 20, 2008

(51) Int. Cl.
*A63B 21/072* (2006.01)

(52) U.S. Cl. ..... 482/108; 482/107

(58) Field of Classification Search ..... 482/8, 482/107, 908, 93, 94, 106, 109, 98, 108, 482/92; *A63B 21/72*
See application file for complete search history.

(56) References Cited

U.S. PATENT DOCUMENTS 4,529,198 A * 7/1985 Hettick, Jr. ..... 482/104
5,839,997 A 11/1998 Roth et al.
5,876,313 A 3/1999 Krull
6,039,678 A * 3/2000 Dawson ..... 482/107
6,228,003 B1 * 5/2001 Hald et al. ..... 482/107
6,261,022 B1 * 7/2001 Dalebout et al. ..... 482/107
6,416,446 B1 * 7/2002 Krull ..... 482/108
6,500,101 B1 * 12/2002 Chen ..... 482/107
6,540,650 B1 4/2003 Krull
6,656,093 B2 12/2003 Chen
6,899,661 B1 * 5/2005 Krull ..... 482/107
7,025,713 B2 * 4/2006 Dalebout et al. ..... 482/107
7,090,625 B2 * 8/2006 Chermack ..... 482/108
7,121,988 B2 * 10/2006 Walkerdine ..... 482/106
7,137,932 B2 * 11/2006 Doudiet ..... 482/107
7,223,214 B2 5/2007 Chen
2002/0183174 A1 12/2002 Chen
2003/0148862 A1 8/2003 Chen et al.
2004/0005969 A1 * 1/2004 Chen ..... 482/107
2004/0198569 A1 * 10/2004 Sanford-Schwentke et al. .. 482/108
2006/0105891 A1 * 5/2006 Cappellini et al. ..... 482/107

* cited by examiner

*Primary Examiner*—LoAn H. Thanh
*Assistant Examiner*—Sandhara M Ganesan
(74) *Attorney, Agent, or Firm*—Pillsbury Winthrop Shaw Pittman LLP

(57) ABSTRACT

A dumbbell includes: a hollow grip bar having a connecting end; a weight adjusting mechanism including a screw rod extending into the grip bar and operable to rotate relative to the grip bar about a rotation axis, and a weight carrier extending into the grip bar and engaging threadedly the screw rod so as to be movable axially upon rotation of the screw rod about the rotation axis, the weight carrier having a weight-supporting part extending outwardly through the connecting end of the grip bar; and a plurality of weights, each of which is formed with an elongate notch having an enlarged central portion for extension of the weight-supporting part of the weight carrier therethrough.

7 Claims, 11 Drawing Sheets

DUMBBELL

BACKGROUND OF THE INVENTION

1. Field of the Invention

This invention relates to a dumbbell, more particularly to a dumbbell having a weight adjusting mechanism that includes a screw rod and a weight carrier engaging threadedly the screw rod.

2. Description of the Related Art

U.S. Pat. No. 6,656,093 discloses a conventional adjustable dumbbell assembly including a rod, a plurality of weights engaged selectively onto one end of the rod, and a spring-biased latch slidably engaged in the end of the rod and movable to permit the rod to engage selectively at least one of the weights so as to secure selectively the selected weight(s) to the end of the rod. However, the aforesaid conventional adjustable dumbbell assembly is disadvantageous in that operation of the spring-biased latch is inconvenient.

SUMMARY OF THE INVENTION

Therefore, the object of the present invention is to provide a dumbbell that can overcome the aforesaid drawback of the prior art.

According to this invention, there is provided a dumbbell that comprises: a hollow grip bar having a connecting end; a weight adjusting mechanism including a screw rod extending into the grip bar and operable to rotate relative to the grip bar about a rotation axis, and a weight carrier extending into the grip bar and engaging threadedly the screw rod so as to be movable axially upon rotation of the screw rod about the rotation axis, the weight carrier having a weight-supporting part extending outwardly through the connecting end of the grip bar; and a plurality of weights, each of which is formed with an elongate notch having an enlarged central portion for extension of the weight-supporting part of the weight carrier therethrough.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
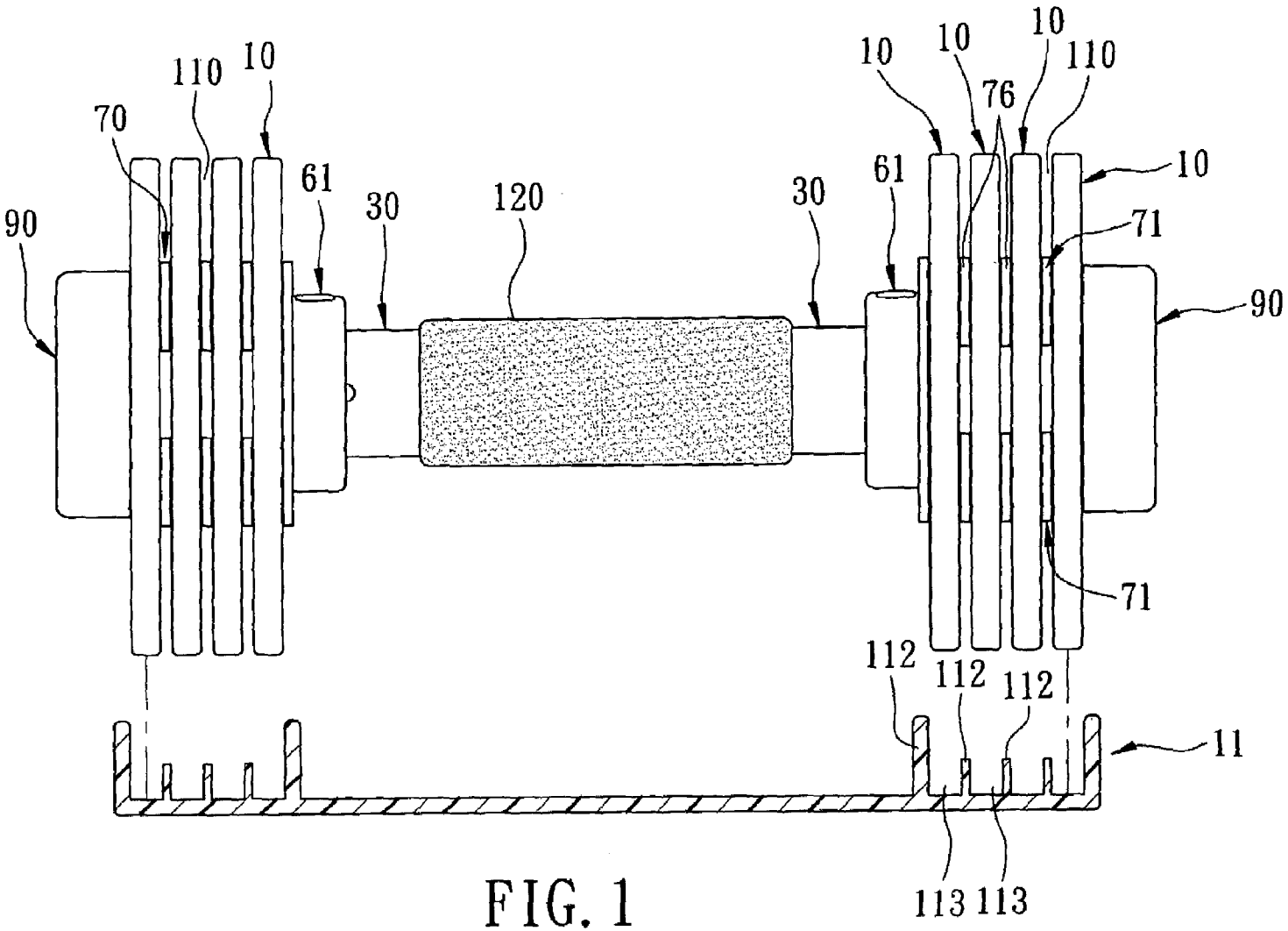
FIG. 1 is a schematic partly sectional side view of the preferred embodiment of a dumbbell assembly.
Figure 2:
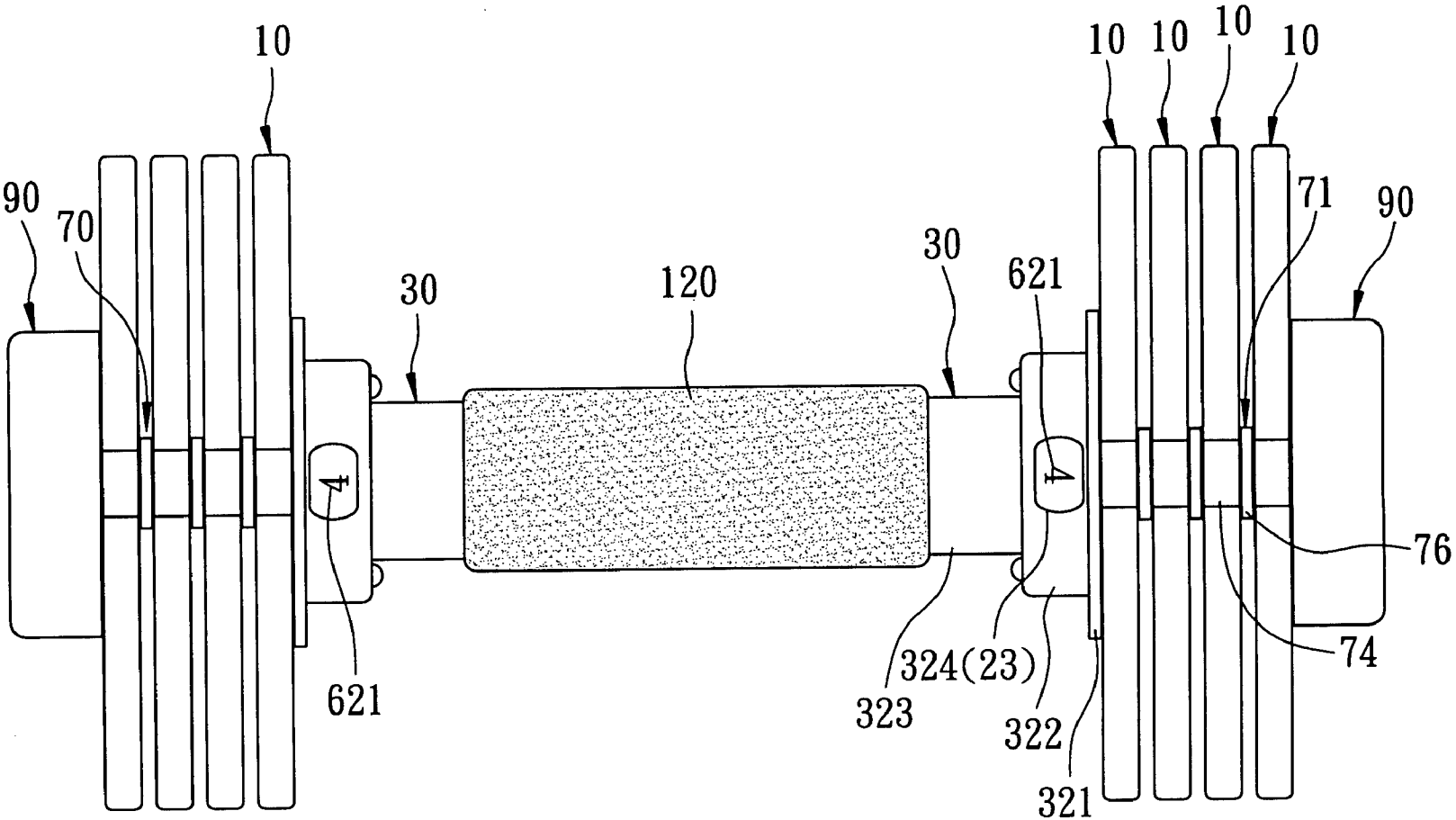
FIG. 2 is a schematic top view of the preferred embodiment.
Figure 3:
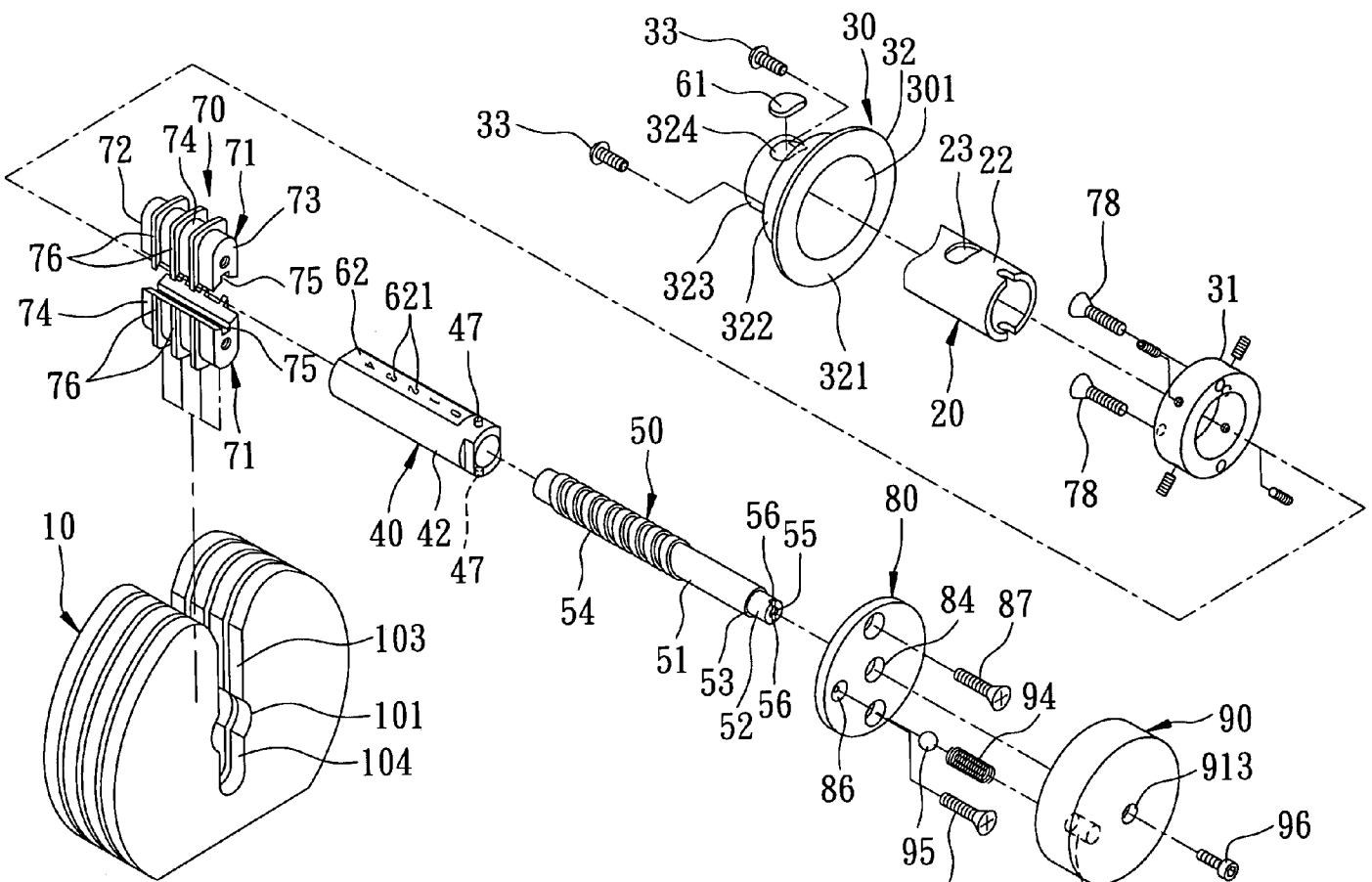
FIG. 3 is an exploded perspective view of the preferred embodiment.

FIGS. 1 to 3 and FIG. 7 illustrate the preferred embodiment of a dumbbell assembly according to this invention. The dumbbell assembly includes a dumbbell and a dumbbell-mounting seat 11.

The dumbbell includes: a hollow grip bar 20 having two opposite connecting ends 22; two weight adjusting mechanisms connected respectively to the connecting ends 22 of the grip bar 20, each of the weight adjusting mechanisms including a screw rod 50 extending into the grip bar 20 and operable to rotate relative to the grip bar 20 about a rotation axis, and a weight carrier 40 extending into the grip bar 20 and engaging threadedly the screw rod 50 so as to be movable axially upon rotation of the screw rod 50 about the rotation axis, the weight carrier 40 of each of the weight adjusting mechanisms having a weight-supporting part 42 extending outwardly through a respective one of the connecting ends 22 of the grip bar 20; and a plurality of weights 10, each of which is formed with an elongate notch 100 having an enlarged central portion 101 for extension of the weight-supporting part 42 of the weight carrier 40 therethrough. The grip bar 20 has a middle portion 21 (see FIG. 7) extending between the connecting ends 22 and having a friction-providing sleeve 120 sleeved thereon.

Figure 6:
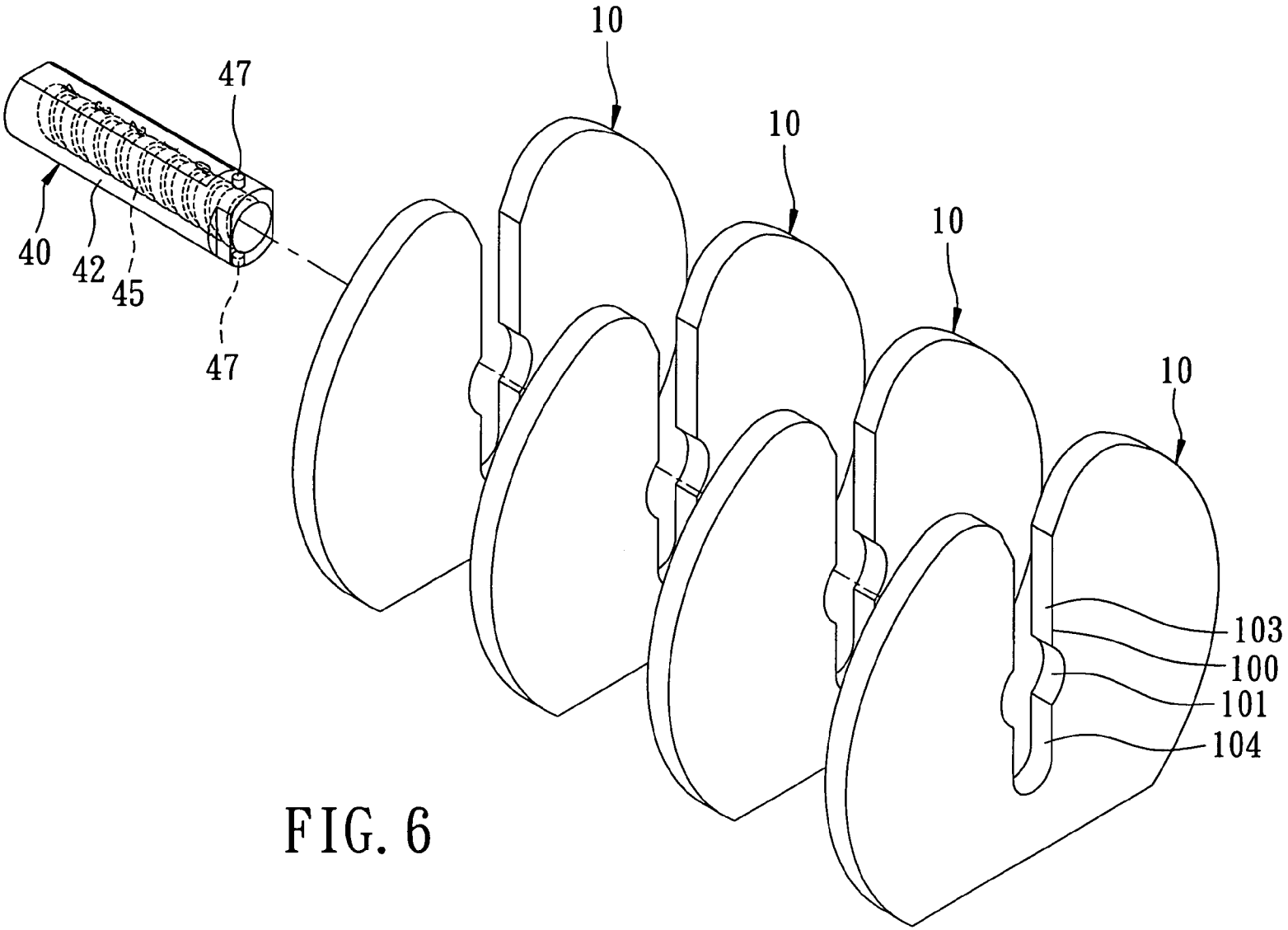
FIG. 6 is an exploded perspective view to illustrate a weight carrier of the preferred embodiment.

In this embodiment, the weight carrier 40 is in the form of a tubular member sleeved on the screw rod 50 and formed with an inner thread 45 (see FIG. 6) that engages threadedly an outer thread 54 of the screw rod 50. Each of the weight adjusting mechanisms further includes a limiting member 70 secured to a respective one of the connecting ends 22 of the grip bar 20, disposed outwardly of the grip bar 20, defining an axially extending central channel 701 (see FIG. 7) for extension of the weight-supporting part 42 of the weight carrier 40 thereinto, and formed with two opposite inner limiting grooves 75 extending axially and in spatial communication with the central channel 701. The weight-supporting part 42 of the weight carrier 40 has a free end 421 formed with two opposite limiting protrusions 47 that extend respectively into the inner limiting grooves 75 in the limiting member 70 so as to prevent rotation of the weight carrier 40 upon rotation of the screw rod 50 about the rotation axis and so as to permit axial movement of the weight carrier 40 upon rotation of the screw rod 50.

Each of the weight adjusting mechanisms further includes a fastening unit secured to a respective one of the connecting ends 22 of the grip bar 20, and including a fastening sleeve 30 that has a first annular portion 323 sleeved on the respective connecting end 22 of the grip bar 20, and a second annular portion 322 enlarged in diameter from the first annular portion 323 and defining an inner space 301. The fastening unit further includes a fastening ring 31 fitted into the inner space 301 in the second annular portion 322 of the fastening sleeve 32, fastened to the second annular portion 322 through fasteners 33, and sleeved on the respective connecting end 22 of the grip bar 20, and fastening screws 78 for fastening one end 72 of the limiting member 70 to the fastening ring 31. An annular flange 321 radiates outwardly from one end of the second annular portion 322, and has a surface flush with an outer surface of the fastening ring 31 and abutting against the end of the limiting member 70.

Each of the weight adjusting mechanisms further includes a mounting plate 80 secured to the other end 73 of the limiting member 70 through fasteners 87, and an operating cap 90 sleeved rotatably on the mounting plate 80 and connected securely to the screw rod 50 for manually driving rotation of the screw rod 50.

The screw rod 50 has a non-threaded segment 51 extending through the central channel 701, and a reduced end portion 52 that is reduced in diameter from the non-threaded segment 51 to define a shoulder 53 thereat, and that is formed with an inner thread 55. The reduced end portion 52 of the screw rod 50 extends through a central hole 84 in the mounting plate 80 such that the shoulder 53 abuts against a periphery of the central hole 84 in the mounting plate 80 (see FIG. 7). Each of the weight adjusting mechanisms further includes a counter bolt 96. The operating cap 90 is fastened to the reduced end portion 52 of the screw rod 50 through threaded engagement between the counter bolt 96 and the inner thread 55 in the reduced end portion 52 of the screw rod 50.

Figure 4:
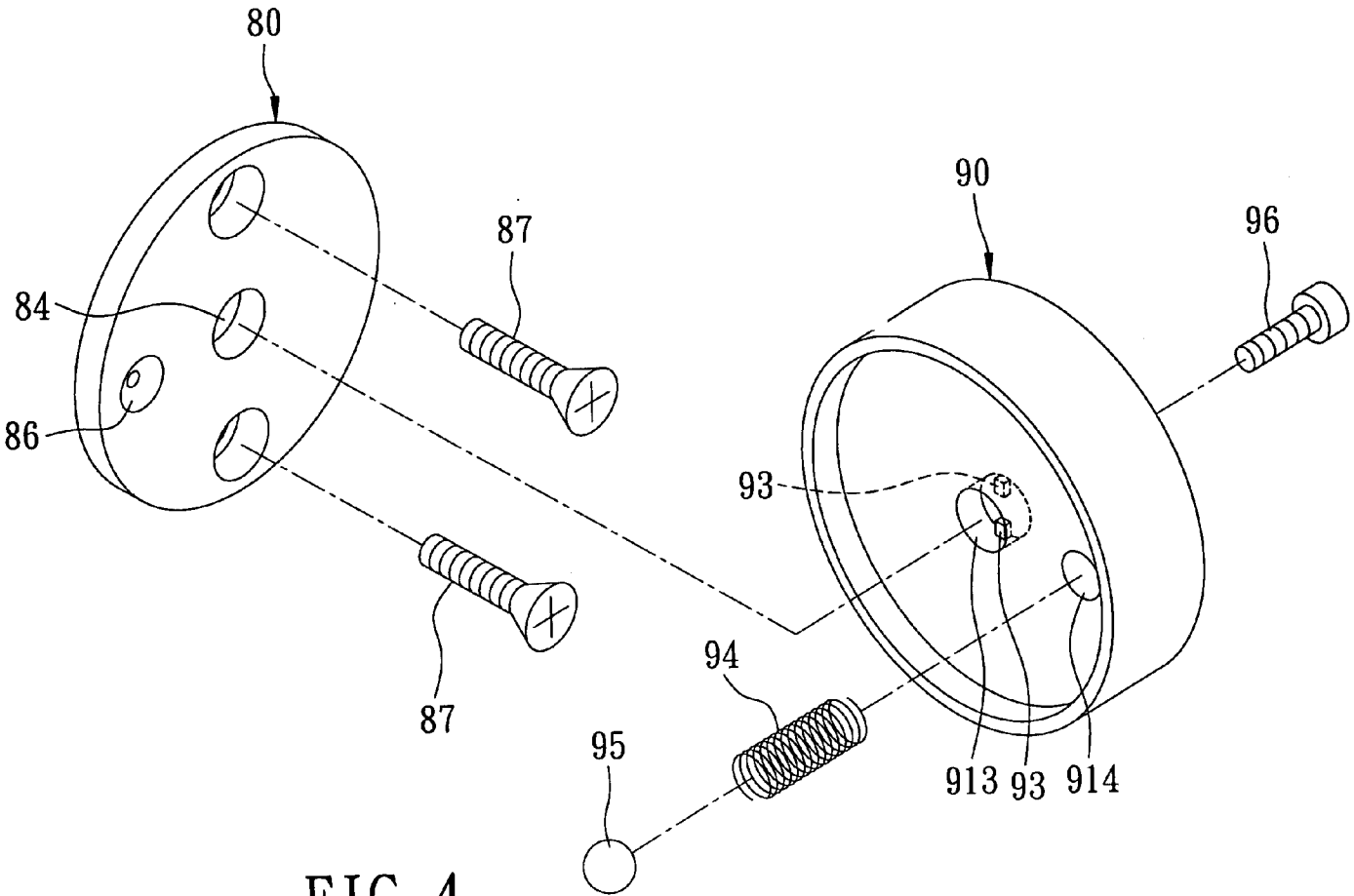
FIG. 4 is an exploded perspective view to illustrate the configuration of a turn-indicating unit of the preferred embodiment.
Figure 5:
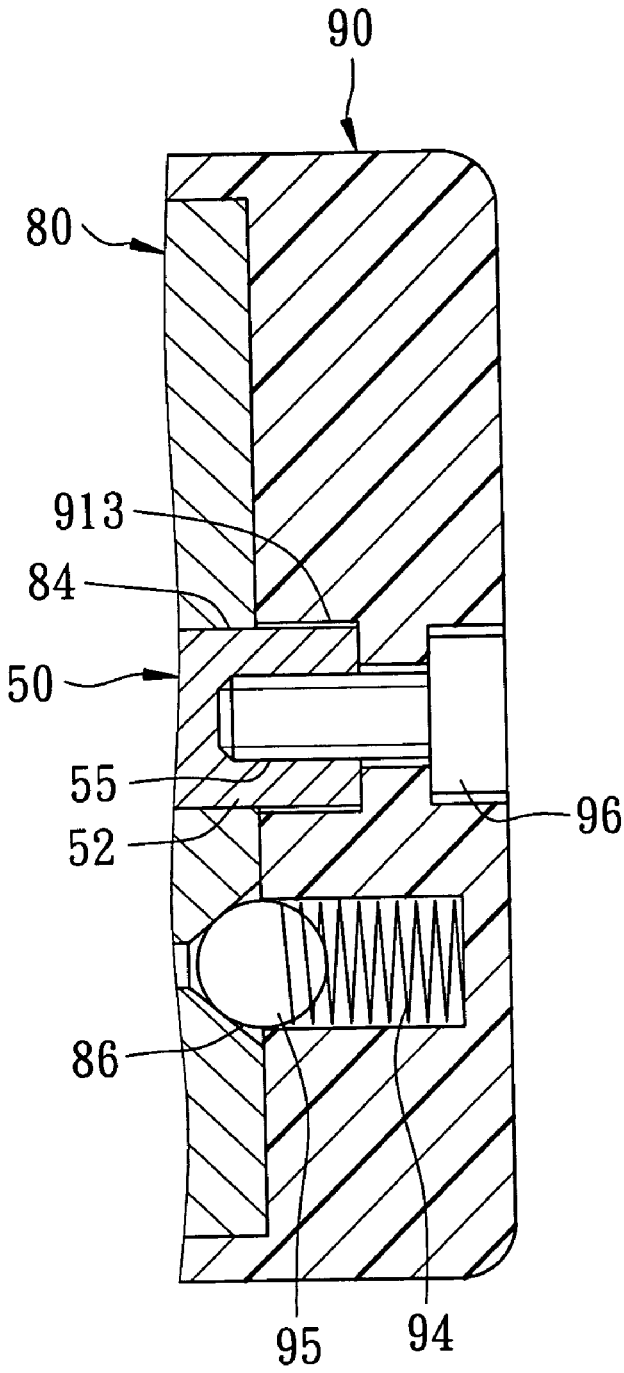
FIG. 5 is a fragmentary sectional view of the turn-indicating unit of the preferred embodiment.

Referring to FIGS. 4 and 5, the mounting plate 80 is formed with a first recess 86. The operating cap 90 is formed with a second recess 914. Each of the weight adjusting mechanisms further includes a turn-indicating unit that includes a coil spring 94 mounted in the second recess 914, and a ball 95 urged and carried by the coil spring 94 and co-rotatable with the operating cap 90 so as to be received in the first recess 86 in the mounting plate 80 and so as to generate a clicking sound when the operating cap 90 is rotated to an angular position where the first and second recesses 86, 914 are axially aligned (see FIG. 5). As such, engagement between the ball 95 and the first recess 86 in the mounting plate 80 during rotation of the operating cap 90 can assist the user in sensing the number of turns in order to achieve the desired weights 10 to be carried by the weight carrier 40.

The operating cap 90 is formed with a countered bore 913 for extension of the counter bolt 96 therethrough. The countered bore 913 is defined by a bore-defining wall that is formed with a pair of diametrically disposed tongues 93. The reduced end portion 52 of the screw rod 50 has an end formed with a pair of diametrically disposed guiding notches 56 for extension of the tongues 93 thereinto, respectively.

The limiting member 70 includes upper and lower blocks 71 that are spaced apart from each other by a space which defines the central channel 701. The upper and lower blocks 71 respectively have a lower end and an upper end that are respectively formed with the inner limiting grooves 75. Each of the upper and lower blocks 71 is formed with a plurality of spaced apart partitioning fins 76 that extend outwardly therefrom and that divide the respective one of the upper and lower blocks 71 into fin-free segments 74. The elongate notch 100 of each of the weights 10 further has opposite upper and lower portions 103, 104 (see FIG. 3) that are reduced in width from the enlarged central portion 101. Two adjacent ones of the weights 10 cooperatively define a gap 110 (see FIG. 1) therebetween. Each of the partitioning fins 76 of each of the upper and lower blocks 71 extends into the gap 110 between two adjacent ones of the weights 10. Each of the fin-free segments 74 of each of the upper and lower blocks 71 is received in a respective one of the upper and lower portions 103, 104 of the elongate notch 100 in a respective one of the weights 10.

The weight carrier 40 has an outer surface 62 that is formed with a weight scale 62 with marks 621 corresponding to the numbers of the weights 10 supported on the weight-supporting part 42 of the weight carrier 40. Each of the connecting ends 22 of the grip bar 20 is formed with a sight window 23 so as to permit viewing of one of the marks 621 that is aligned with the sight window 23. The first annular portion 323 of the fastening sleeve 32 of the fastening unit of each of the weight adjusting units is formed with a view hole 324 that is registered with the sight window 23 in the respective connecting end 22 of the grip bar 20 and that is provided with a sight glass 61 so as to enable view of the mark 621 that is aligned with the sight window 23 (see FIG. 2).

The dumbbell-mounting seat 11 is formed with a plurality of slots 113, which are defined by a plurality of partitioning plates 112, for receiving and supporting the weights 10, respectively.

Figure 7:
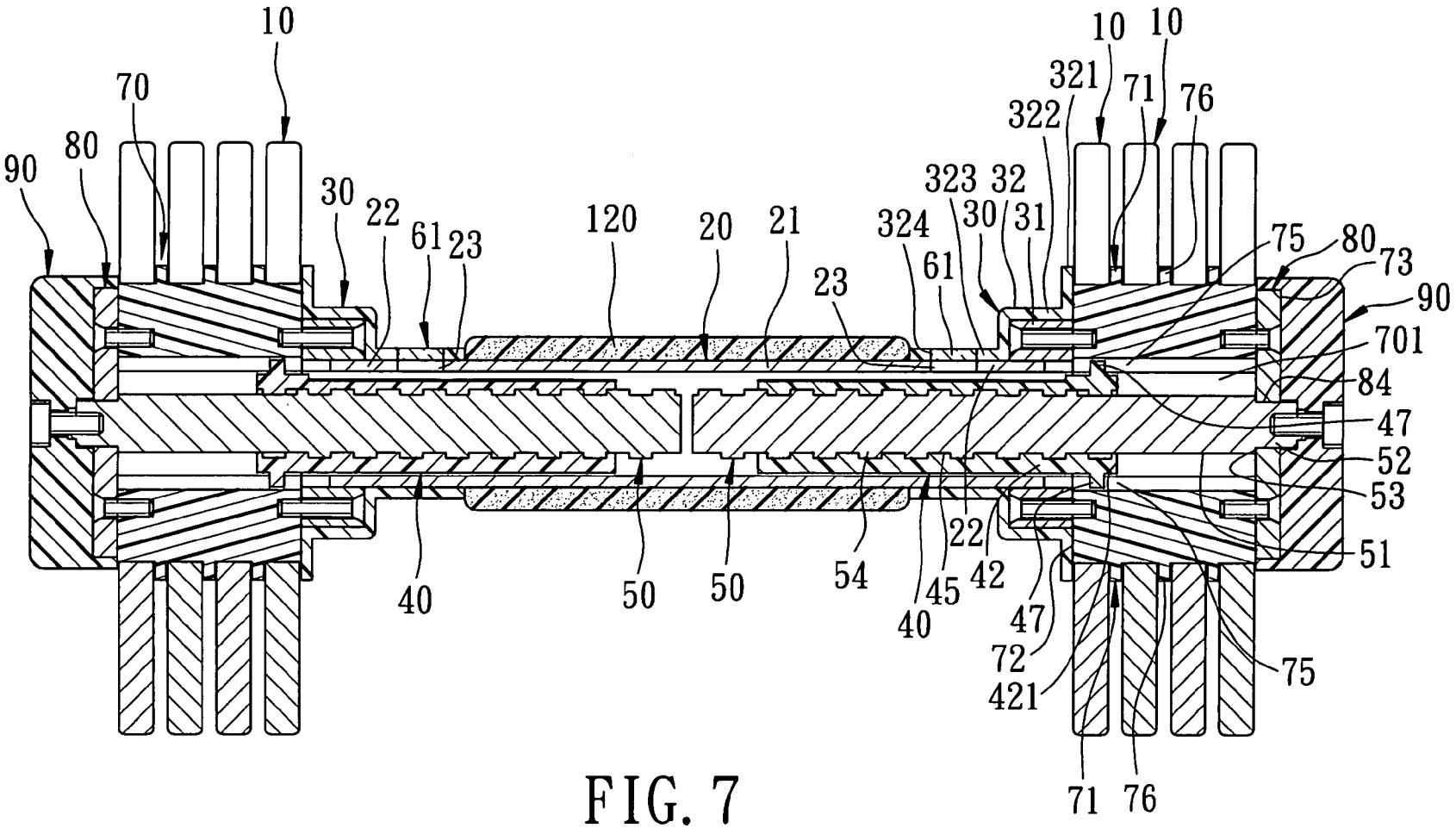
FIG. 7 is a sectional view to illustrate a state where the weight carrier is moved to a position for carrying one of a plurality of weights of the preferred embodiment.
Figure 8:
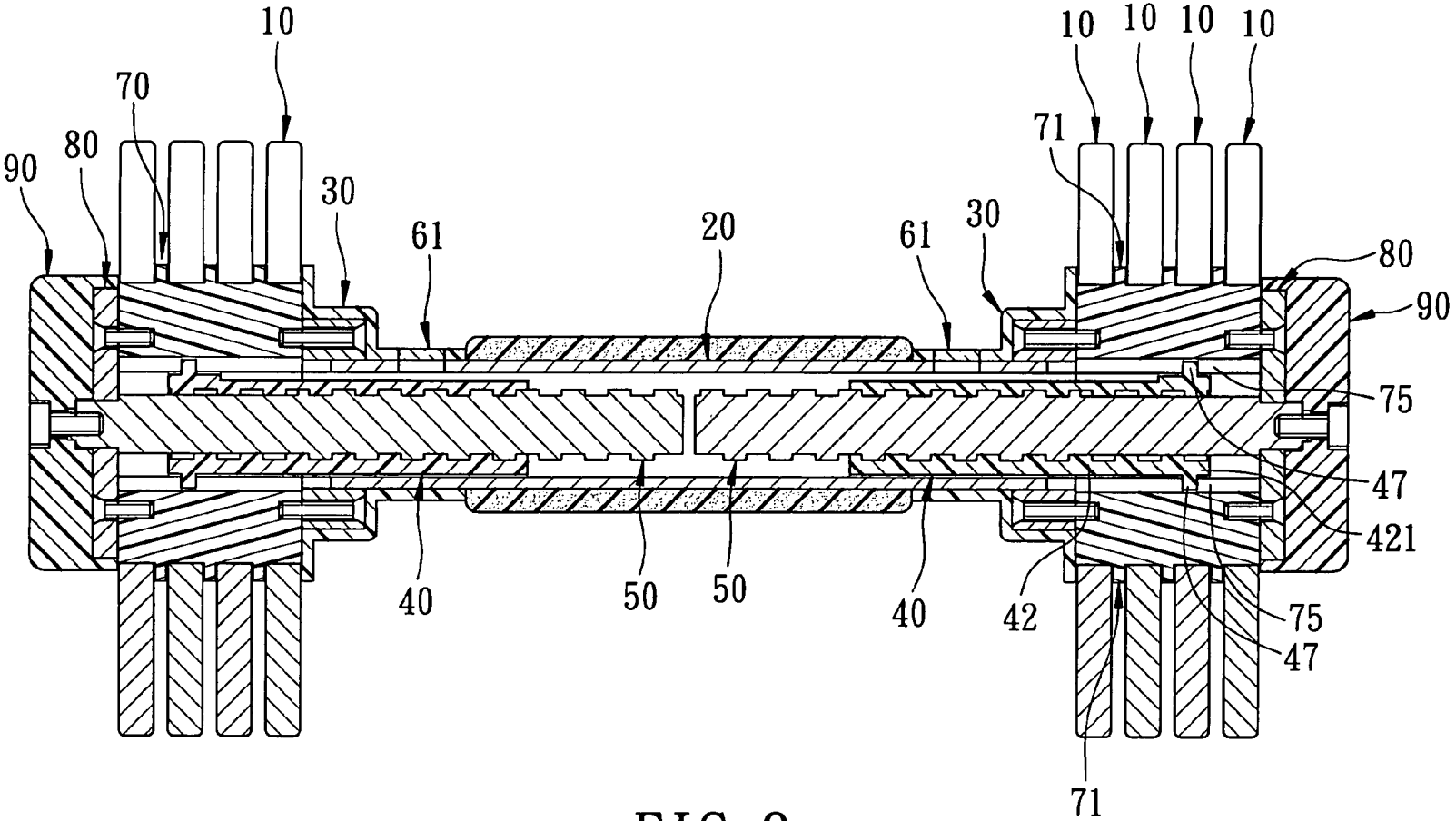
FIG. 8 is a sectional view to illustrate another state where the weight carrier is moved to another position for carrying three of the weights of the preferred embodiment.
Figure 9:
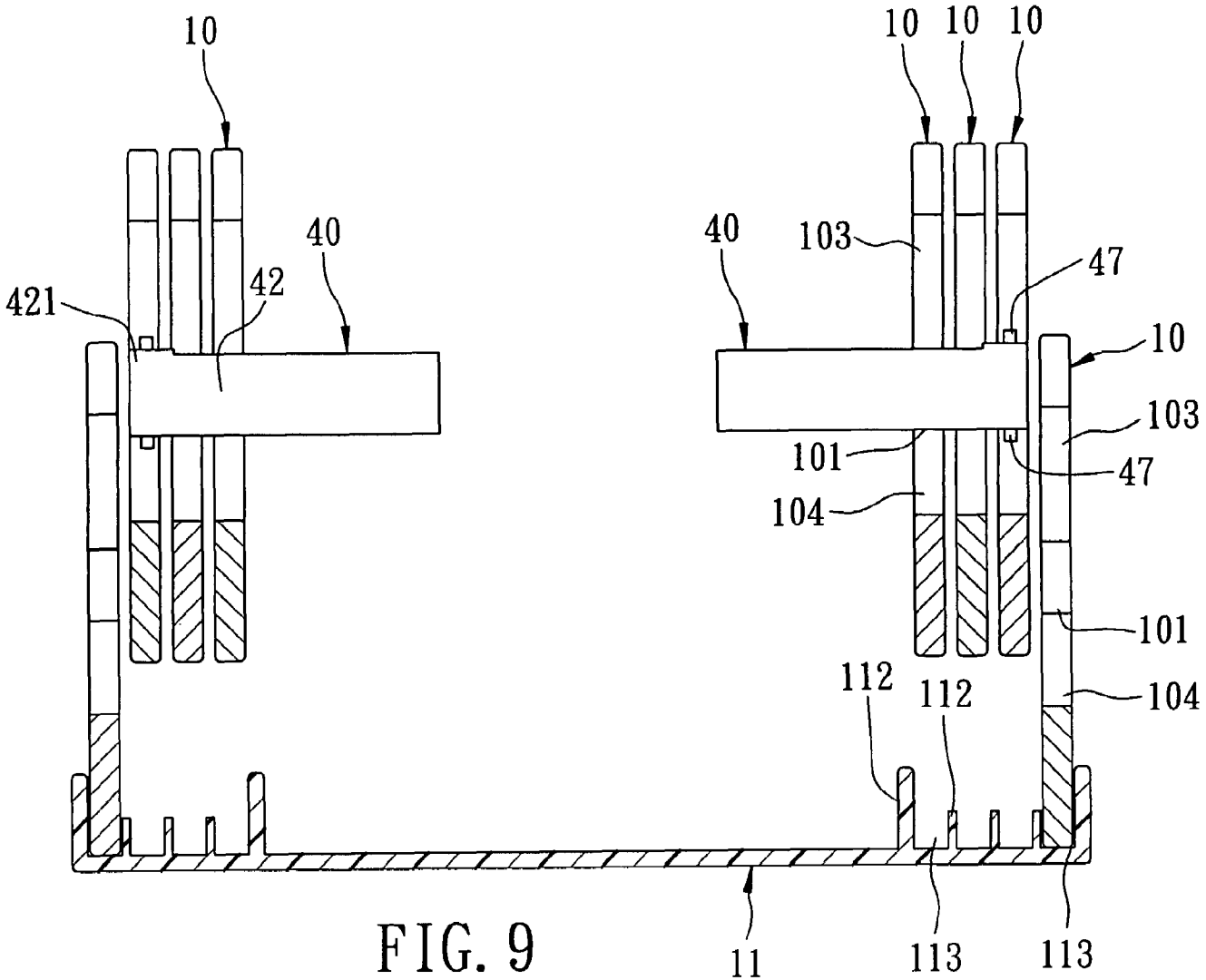
FIG. 9 is a sectional view to illustrate a state where the weight carrier together with three of the weights is lifted from a mounting seat of the preferred embodiment.
Figure 10:
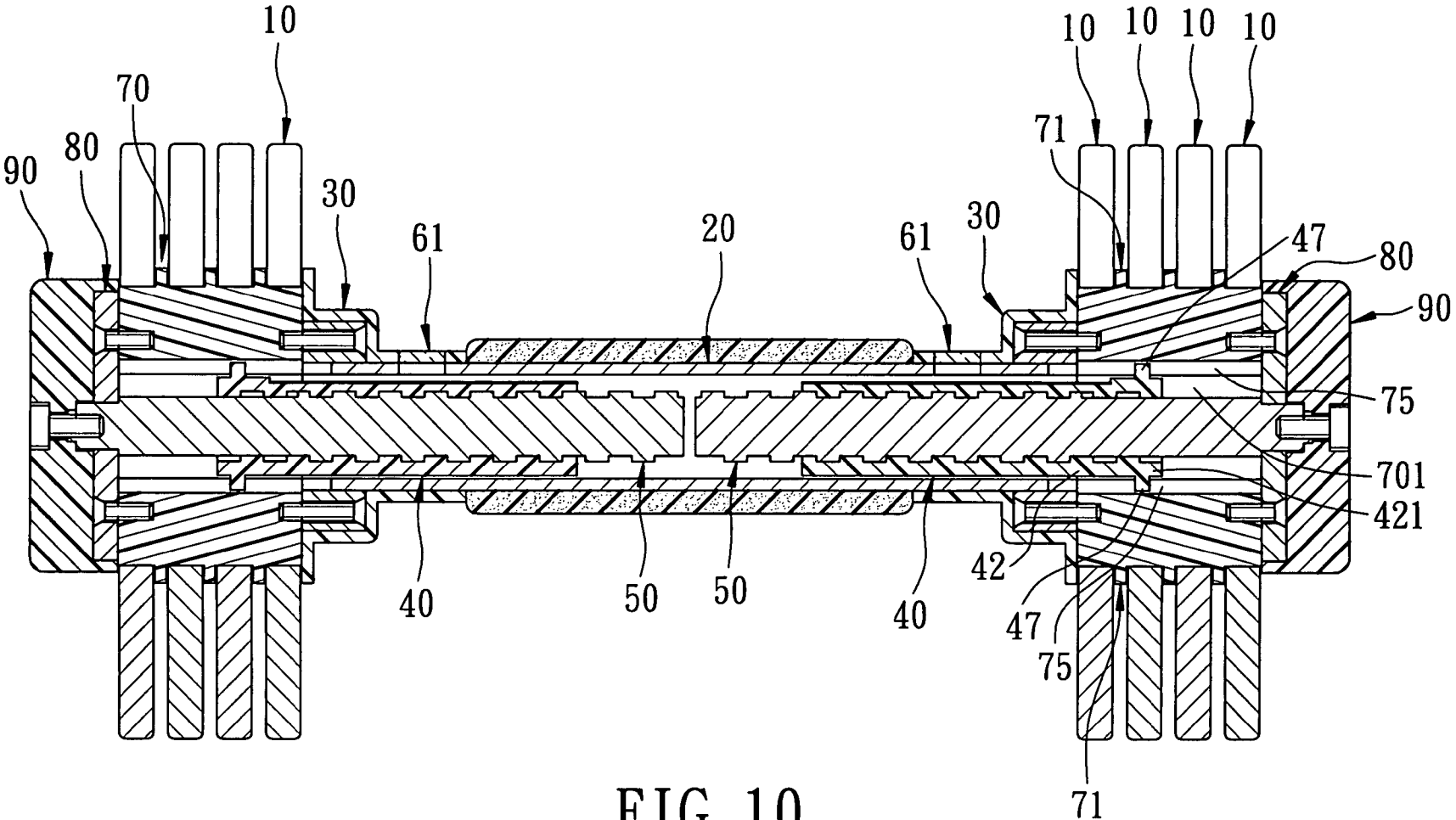
FIG. 10 is a sectional view to illustrate yet another state where the weight carrier is moved to yet another position for carrying two of the weights of the preferred embodiment.
Figure 11:
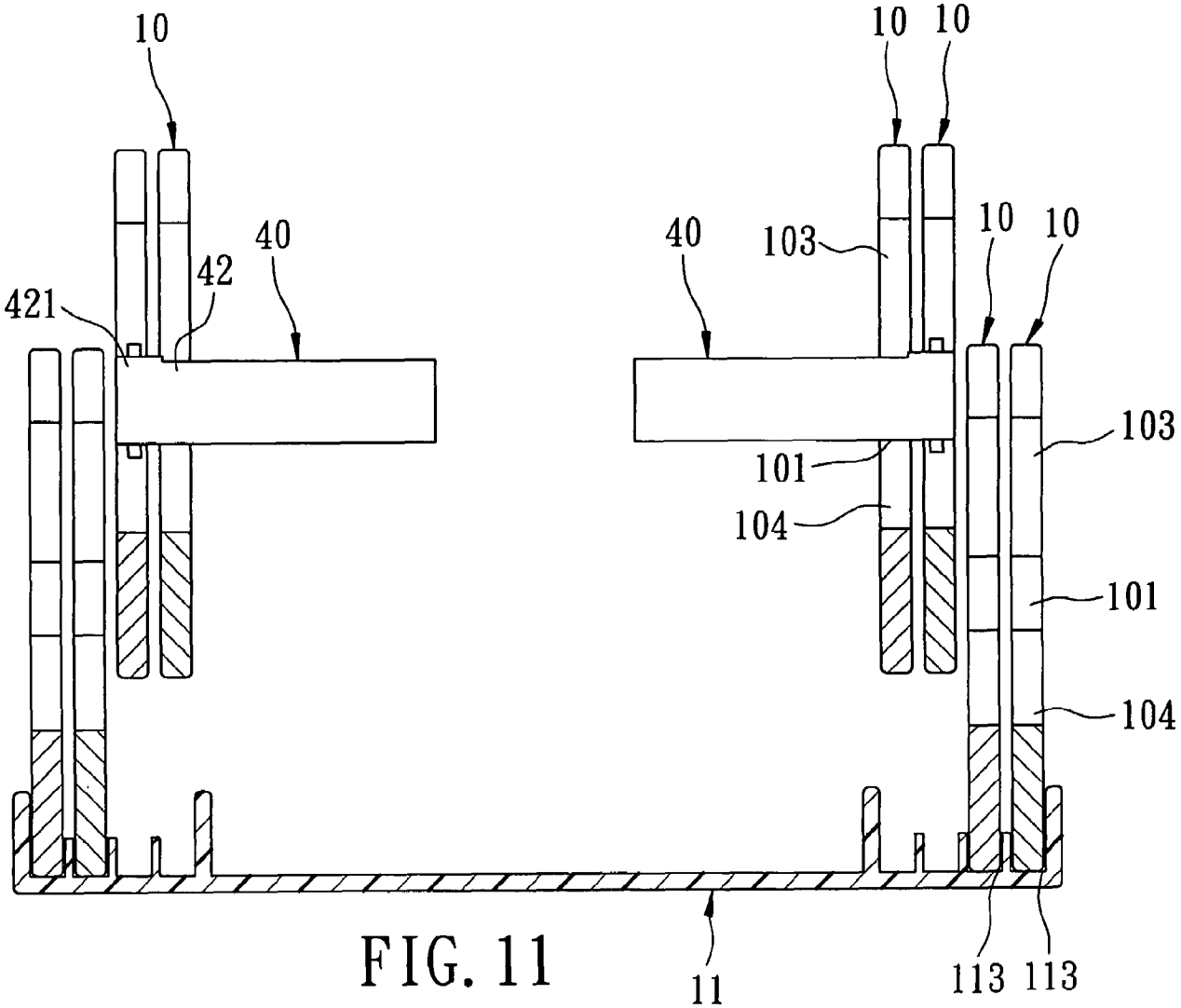
FIG. 11 is a sectional view to illustrate another state where the weight carrier together with two of the weights is lifted from the mounting seat of the preferred embodiment.

In operation, the user can adjust the weight loaded on the connecting ends 22 of the grip bar 20 through rotation of the operating caps 90 of the weight adjusting units. FIG. 7 illustrates a state where the weight-supporting part 42 of the weight carrier 40 is disposed at an axial position in which the free end 421 of the weight-supporting part 42 of the weight carrier 40 reaches to only the leftmost one of the weights 10, which permits the weight carrier 40 to carry only one of the weights 10. As illustrated in FIGS. 8 and 9, when it is desired to carry three of the weights 10 from the state shown in FIG. 7, the weight-supporting part 42 of the weight carrier 40 is advanced through rotation of the operating cap 90 in a first rotation direction to another axial position in which the free end 421 of the weight-supporting part 42 of the weight carrier 40 reaches to the third one of the weights 10 from the left side. As illustrated in FIGS. 10 and 11, when it is desired to carry two of the weights 10 from the state shown in FIG. 8, the weight-supporting part 42 of the weight carrier 40 is withdrawn through rotation of the operating cap 90 in a second rotation direction opposite to the first rotation direction to yet another axial position in which the free end 421 of the weight-supporting part 42 of the weight carrier 40 reaches to the second one of the weights 10 from the left side.

With the inclusion of the weight-adjusting mechanisms in the dumbbell of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A dumbbell comprising:

a hollow grip bar having a connecting end;

a weight adjusting mechanism disposed at each end of the hollow grip bar and including a screw rod extending into said grip bar, and operable to rotate relative to said grip bar about a rotation axis, and a weight carrier extending into said grip bar and engaging threadedly said screw rod so as to be movable axially upon rotation of said screw rod about said rotation axis, said weight carrier having at least a portion thereof capable of extending outwardly through said connecting end of said grip bar;

a rotatable knob at the connecting end of the dumbbell, said rotatable knob being operatively connected with the screw rod such that rotation of the rotatable knob causes rotation of the screw rod which, in turn, generates linear motion of the weight carrier within the receiving portion of the weights as a result of the threaded engagement between the screw rod and the weight carrier; and a plurality of weights, each of said plurality of weights comprising an elongate notch having a receiving portion for receiving said weight carrier therethrough; and wherein there is no threaded engagement between the weight carrier and the weights during movement of the weight carrier through the receiving portion, wherein said weight carrier comprises a tubular member sleeved on said screw rod and formed with an inner thread that threadedly engages said screw rod, and wherein said weight adjusting mechanism further includes a limiting member secured to said connecting end of said grip bar, disposed outwardly of said grip bar, defining an axially extending central channel for extension of a weight supporting part of said weight carrier thereinto, and formed with an inner limiting groove extending axially and in spatial communication with said central channel, said weight-supporting part of said weight carrier being formed with a limiting protrusion that extends into said inner limiting groove in said limiting member so as to prevent rotation of said weight carrier upon rotation of said screw rod about said rotation axis.

2. The dumbbell of claim 1, wherein said weight adjusting mechanism further includes a fastening unit secured to said connecting end of said grip bar and including a fastening sleeve that has a first annular portion sleeved on said connecting end of said grip bar, and a second annular portion enlarged in diameter from said first annular portion and defining an inner space, said fastening unit further including a fastening ring fitted into said inner space in said second annular portion of said fastening sleeve and sleeved on said connecting end of said grip bar, and fastening screws for fastening one end of said limiting member to said fastening ring.

3. The dumbbell of claim 2, wherein said weight adjusting mechanism further includes a mounting plate secured to the other end of said limiting member, and an operating cap sleeved rotatably on said mounting plate and connected securely to said screw rod for manually driving rotation of said screw rod.

4. The dumbbell of claim 3, wherein said screw rod has a non-threaded segment extending through said central channel, and a reduced end portion that is reduced in diameter from said non-threaded segment to define a shoulder thereat, and that is formed with an inner thread, said weight adjusting mechanism further including a counter bolt, said operating cap being fastened to said reduced end portion of said screw rod through threaded engagement between said counter bolt and said inner thread in said reduced end portion of said screw rod.

5. The dumbbell of claim 4, wherein said mounting plate is formed with a first recess, said operating cap being formed with a second recess, said weight adjusting mechanism further including a coil spring mounted in said second recess, and a ball urged and carried by said coil spring and co-rotatable with said operating cap so as to be received in said first recess when said first and second recesses are axially aligned.

6. The dumbbell of claim 4, wherein said operating cap is formed with a countered bore for extension of said counter bolt therethrough, said countered bore being defined by a bore-defining wall that is formed with a pair of diametrically disposed tongues, said reduced end portion of said screw rod having an end formed with a pair of diametrically disposed guiding notches for extension of said tongues thereinto, respectively.

7. The dumbbell of claim 1, wherein said limiting member includes upper and lower blocks that are spaced apart from each other by a space which defines said central channel, one of said upper and lower blocks being formed with said inner limiting groove, each of said upper and lower blocks being formed with a plurality of spaced apart partitioning fins that extend outwardly therefrom and that divide the respective one of said upper and lower blocks into fin-free segments, said elongate notch of each of said weights further having opposite upper and lower portions that are reduced in width from said enlarged central portion, two adjacent ones of said weights cooperatively defining a gap therebetween, each of said partitioning fins of each of said upper and lower blocks extending into said gap between two adjacent ones of said weights, each of said fin-free segments of each of said upper and lower blocks being received in a respective one of said upper and lower portions of said elongate notch in a respective one of said weights.

* * * * *